US007134560B2

(12) United States Patent
Goodwin

(10) Patent No.: US 7,134,560 B2
(45) Date of Patent: Nov. 14, 2006

(54) PORTABLE RACKS FOR DRYING OR STORING ITEMS, SUPPORT ARMS THEREFOR, AND METHODS OF CONSTRUCTING AND UTILIZING SAME

(76) Inventor: Brad Arnold Goodwin, 2737 Fowler Rd., Harrisville, MI (US) 48740

( * ) Notice: Subject to any disclaimer, the term of this patent is extended or adjusted under 35 U.S.C. 154(b) by 0 days.

(21) Appl. No.: 10/861,868

(22) Filed: Jun. 4, 2004

(65) Prior Publication Data

US 2005/0011847 A1 Jan. 20, 2005

Related U.S. Application Data

(60) Provisional application No. 60/565,349, filed on Apr. 26, 2004, provisional application No. 60/476,655, filed on Jun. 6, 2003.

(51) Int. Cl.
*A47H 1/00* (2006.01)

(52) U.S. Cl. ..... 211/101

(58) Field of Classification Search ..... 211/101, 211/196, 205, 107, 112
See application file for complete search history.

(56) References Cited

U.S. PATENT DOCUMENTS

| | | | | |
|---|---|---|---|---|
| 2,277,332 | A * | 3/1942 | Lamb | 211/196 |
| 3,806,399 | A * | 4/1974 | Cocjin | 428/8 |
| 5,862,924 | A * | 1/1999 | Dumont | 211/85.7 |
| D412,414 | S | 8/1999 | Gingrich | |
| 6,702,129 | B1 * | 3/2004 | Harris | 211/196 |

* cited by examiner

*Primary Examiner*—Sarah Purol
(74) *Attorney, Agent, or Firm*—Weiner & Burt, P.C.; Irving M. Weiner; Pamela S. Burt

(57) ABSTRACT

A portable rack for drying or storing articles, and a support arm device therefor. The support arm devices are pivotably secured to an external post so that the support arm can be pivoted from a supportive position to a position of non-use.

13 Claims, 4 Drawing Sheets

FIG 1
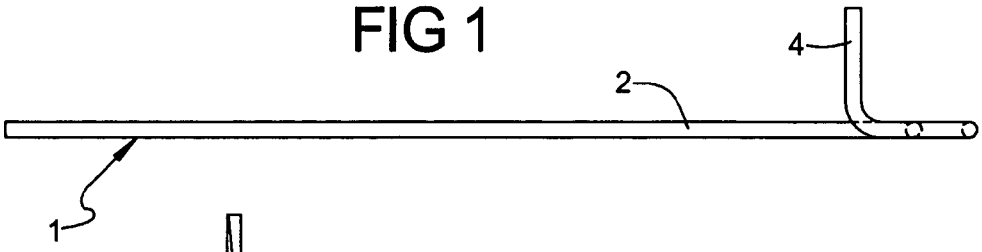
FIG 2
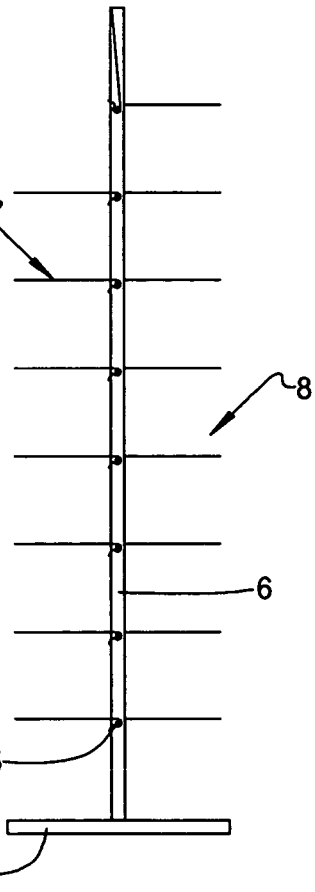
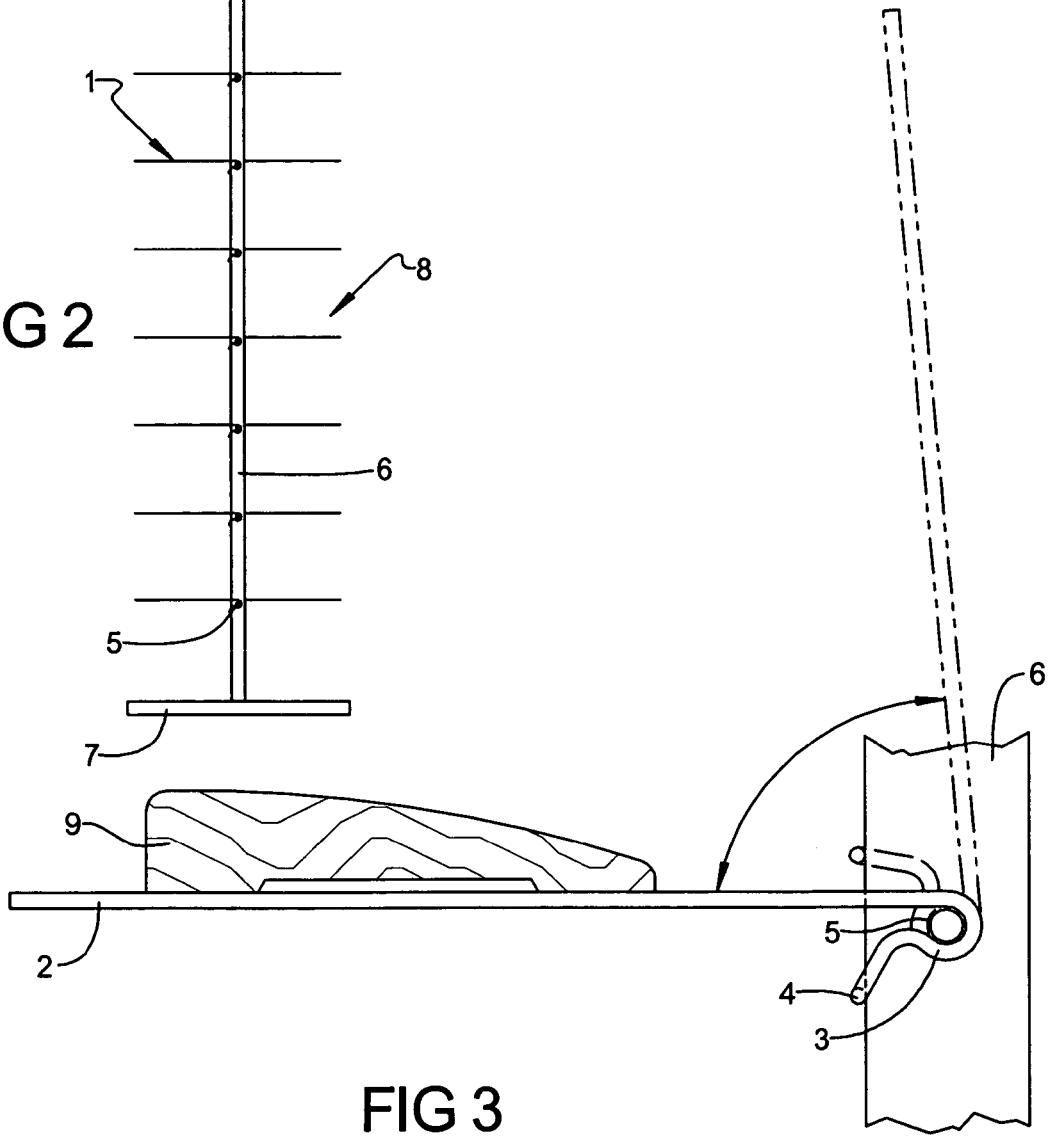
FIG 3

PORTABLE RACKS FOR DRYING OR STORING ITEMS, SUPPORT ARMS THEREFOR, AND METHODS OF CONSTRUCTING AND UTILIZING SAME

The present utility patent application is based on and claims priority from U.S. Provisional Patent Application Ser. No. 60/476,655, filed Jun. 6, 2003, and U.S. Provisional Patent Application Ser. No. 60/565,349, filed Apr. 26, 2004, the entire contents of both of said provisional patent applications being incorporated herein by reference thereto.

The present invention relates generally to novel and unique portable racks for drying or storing a plurality of articles, novel support arms therefor, and method of constructing and utilizing same.

More particularly, the present invention relates to a lightweight, portable rack which is an ideal tool for painters and finish carpenters, a portable rack for hanging clothing items thereon, novel support arms therefor, and methods of constructing and utilizing same.

BACKGROUND OF THE INVENTION

There has been a great need for painters, finish carpenters, tradesman, and other construction workers to have a quick setup, multi-functional, well-organized rack structure for trim drying and/or storage which can easily be set up on the job site. There has also been a great need for clothing racks for home use, for dormitory rooms, for point of sale devices, etc.

The prior art is exemplified by Kollinger Metalbau GmbH European Patent Publication EP 0 865 747 A2; Gingrich U.S. Design Patent 412,414; and Dumont U.S. Pat. No. 5,862,924.

One of the primary desideratum of the present invention is to avoid the animadversions of the prior art and conventional methods and techniques, and to provide novel and unique rack structures for drying and/or storing items, support arms therefor, and methods of constructing and utilizing same.

SUMMARY OF THE INVENTION

The present invention provides a pivotable support arm device, comprising: a main member disposed substantially in a first predetermined plane; a stop member disposed substantially in a second predetermined plane which is oriented substantially perpendicular to said first predetermined plane; said main member and said stop member forming a unitary structure; and means for pivotably securing said support arm device to an external post member so that said support arm device can be pivoted from a supporting position whereat a first predetermined portion of said stop member engages a first predetermined portion of said external post member, to a storage position whereat a second predetermined portion of said stop member engages a second predetermined portion of said external post member.

The present invention also provides a novel and unique portable rack for drying and/or storing a plurality of articles, comprising: an elongated main support member; base means for holding said elongated main support member in a substantially vertical orientation; a plurality of support arms for supporting said plurality of articles; means for selectively pivotally interconnecting said plurality of support arms with said elongated main support member; and each said support arm device being pivotable from a position of non-use to a substantially horizontal position for holding said plurality of articles, and vice versa.

A primary objective of the present invention is to provide a portable rack as described hereinabove in the form of a trim tower.

A further object of the present invention is to provide two or more of said trim towers which are spaced apart a desired distance to temporarily support pieces of wood trim, or other items which need to be dried and/or stored.

Another object of the present invention is to provide such trim towers which allow a job site or paint shop to be multi-functional, well organized, and flexible.

Yet another object of the present invention is to provide a portable rack or trim tower as described hereinabove, which may be constructed of aluminum tubing, a steel base, and heat-treated support arms.

Yet a further object of the present invention is to provide a portable rack or trim tower as described hereinabove, wherein such trim tower or rack is extremely stable, even when loaded on only one side thereof.

Another object of the present invention is to provide a portable rack or trim tower as described hereinabove, which includes a novel or unique support arm which enables the support arm to be pivoted between a stable horizontal supporting position, and a folded-up stable storage position.

Yet a further object of the present invention is to provide a portable rack or trim tower described hereinabove, which (aside from the base) folds down to less than 2 inches square by 84 inches in length.

A further object of the present invention is to provide a portable rack in the form of a trim-tree drying rack which is approximately 84 inches tall and provides 26 shelves by way of its support arms.

Another object of the present invention is to provide portable racks as described hereinabove, in the form of a trim-tree three pack comprising three 84 inch drying racks each having 26 shelves, and having a capacity of 2,063 lineal feet length of 2¼ inch trim boards.

A further object of the present invention is to provide a portable rack for storing and holding various clothing items.

Another object of the present invention is to provide novel and unique support arms for various racks and other devices.

The foregoing objects, advantages and features of the present invention will become more apparent to those persons skilled in this particular area of technology and to others after having been exposed to the following detailed description of the present invention and read in conjunction with the associated patent drawings.

BRIEF DESCRIPTION OF THE DRAWINGS

FIG. 1 illustrates a side elevational view of a novel support arm in accordance with only one possible embodiment of the present invention.

FIG. 2 depicts a side elevational view of the novel portable rack in accordance with only one possible embodiment of the present invention.

FIG. 3 illustrates a partial enlarged view of a support arm as assembled to the main support member in accordance with a preferred embodiment of the present invention.

DETAILED DESCRIPTION OF SOME PREFERRED EMBODIMENTS OF THE PRESENT INVENTION

Figure 4:
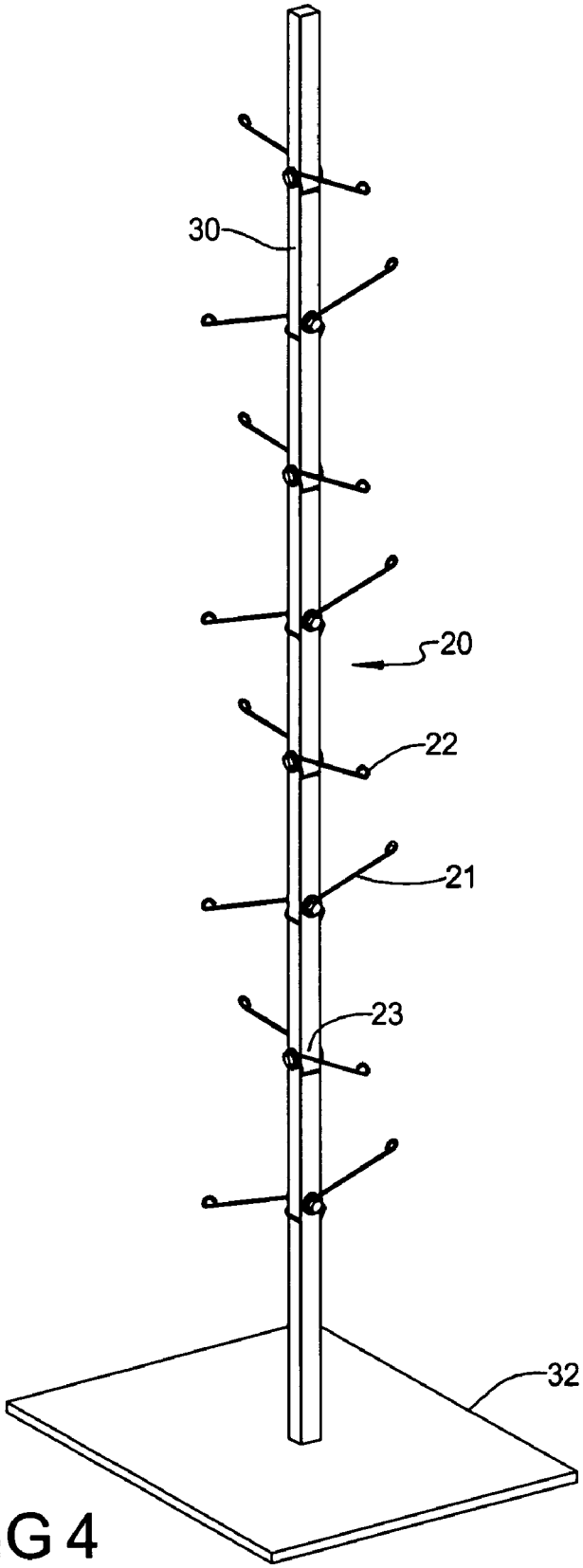
FIG. 4 is a photograph of a second embodiment of the present invention.

With reference to FIGS. 1 and 3, only one possible version of the novel support arm 1 is illustrated. The support arm 1 comprises a main elongated portion 2 which is integral with a curved portion 3, which in turn terminates in an end portion or stop member 4 disposed outside of the plane containing the main elongated portion 2 and the curved portion 3 of the support arm 1.

The curved portion 3 is shaped and adopted to accommodate the passing therethrough of a pivot pin or bolt 5 for pivotally connecting one or two support arms 1 to the elongated main support member 6, which is shown in FIGS. 2 and 3.

Preferably, but not necessarily, the pivot pin or bolt 5 passes all the way through the elongated main support member 6. Preferably, but not necessarily, the pivot bolt 5 can be threaded at its end portion to mate with a threaded nut (not shown). The pivot pins 5 may preferably, but not necessarily, be any conventional bolts threaded at the end with a nut (not shown) for securing to the elongated main support member 6. Preferably, but not necessarily, washers (not shown) may be employed at either end or both ends of the pivot pin 5.

The elongated main support member 6 may be fabricated form any suitable material. Preferably, but not necessarily, the elongated support member 6 is fabricated from aluminum tubing.

With reference to FIG. 2, the elongated support member 6 with its pivotally connected support arms 1 are supported by a base member 7. Preferably, but not necessarily, the base member 7 may be fabricated from steel. The steel base member or base plate 7 is easily and quickly attached to the bottom of the elongated main support member 6 by any suitable means.

Two or more of the portable racks or trim towers 8 (shown in FIG. 2) may be spaced apart any desired distance for temporarily drying or storing a plurality of articles, such as, for example, pieces of wood trim. A cross section of a typical piece of wood trim 9 being supported by a support arm 1 is shown in FIG. 3.

FIG. 3 shows the support arm 1 disposed in a stable horizontal position when it is in use for holding various articles, such as pieces of wood trim 9. The phantom line position of the support arm 1 shown in FIG. 3 shows the support arm 1 that has been pivoted to a position where that particular support arm 1 is not in use.

The top portion of FIG. 2 also shows one of the support arms 1 pivoted substantially vertically when it is not in use. It should be noted that the novel structure and arrangement of the support arm 1 enables the end portion or stop member 4 thereof to bear against the exterior surface of the elongated support member 6 in the use position, as well as in the storage or non-use position.

Preferably, but not necessarily, the vertical spacing between adjacent support arms 1 when in use is approximately six inches.

The length of the support arm 1 can be any desired length, for example, 8 inches, 10 inches, 12 inches, etc. When used for holding wood trim 9, the support arms 1 may be 8 inches to accommodate easily three pieces of wood trim 9.

Alternatively, if the portable rack 8 is to be used for supporting heavy articles, such as galvanized pipe, the support arms 1 can be made suitably shorter, for example, two inches long.

Preferably, but not necessarily, the base member 7 may be one foot square by one-half inch thick.

The portable trim tree rack 8, preferably, but not necessarily, weighs 22 pounds, with each being constructed of aluminum tubing, a steel base and heat-treated metal support arms 1. The units 8 may be sold individually or in sets of three.

The portable rack 8 is the ideal tool for painters and finish carpenters. These portable racks 8 allow the job sites or paint shops to be multi-functional, well organized, and flexible, and are ideal for trim drying or storage.

Figure 5:
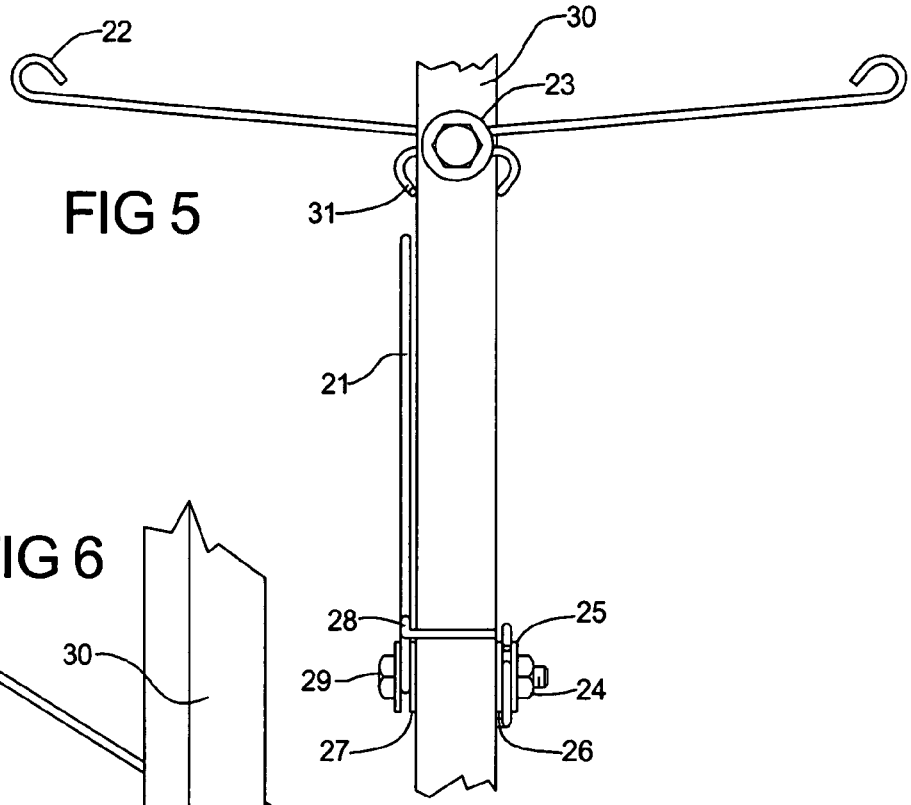
FIG. 5 is a close-up photo of a portion of the FIG. 4 embodiment.
Figure 6:
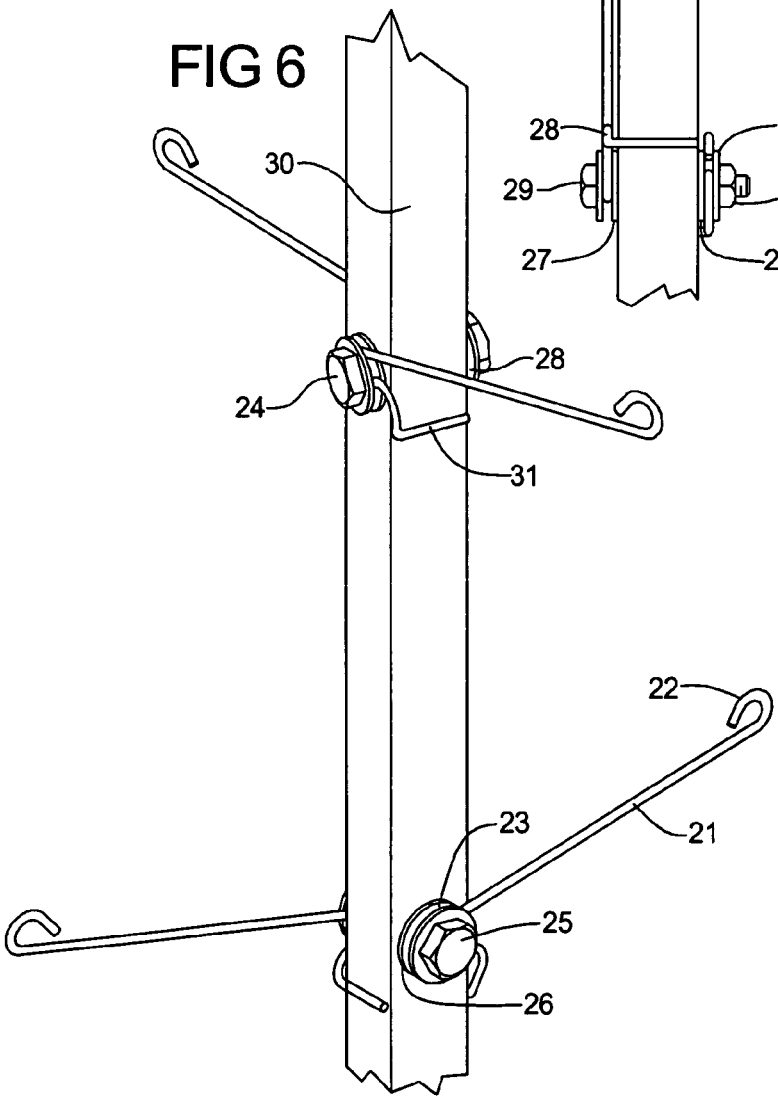
FIG. 6 is a photograph on a close-up basis of another portion of the FIG. 4 and FIG. 5 embodiment.

FIGS. 4–6 show a second embodiment of the present invention in the form of a stand-alone rack 20 for holding clothing and other items. These figures also show an alternate embodiment of the support arms 21 having curved outer ends 22, and an end portion 23 through which is disposed a bolt 24 or pivot pin with an arrangement of washers 25, 26, 27 and 28 and a nut 29 at the opposite end of the bolts 24. The curved portion 23 terminates in a stop tab or end portion 31 disposed outside of (and preferably, but not necessarily, substantially perpendicular to) the plane containing the curved outer end 22, the curved portion 23, and main elongated portion of the support arm 21. The end portion or stop tab 31 functions similar to the abovementioned end portion or stop member 4.

In FIG. 5 it is shown that the arm 21 can be arrayed in its operational position perpendicular to the main post 30 of the rack 20, or in a storage position aligned with the axis of the main post 30 of the rack 20. Preferably, but not necessarily, the base member 32 and the supports arms 21 can be painted a first color, and the main post can be painted a second color, so that said first and second colors conform to the colors of a school, college, university, country club, city, state, province, or country.

Figure 9:
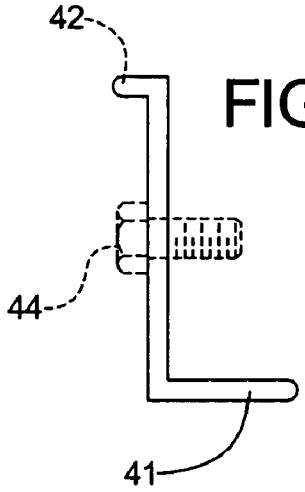
FIG. 9 is a sectional view of the FIG. 7 embodiment.
Figure 7:
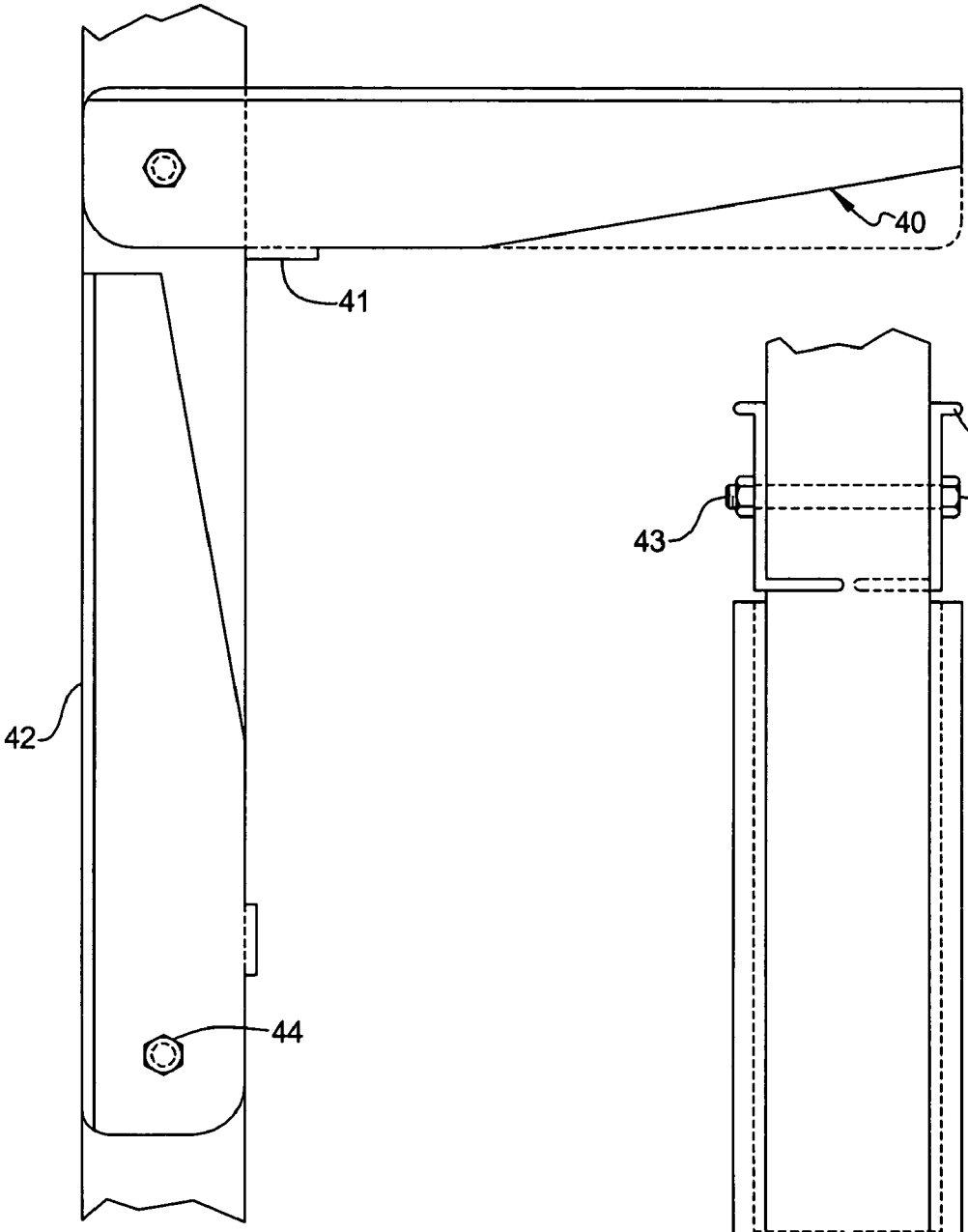
FIG. 7 is a side-elevational view of an alternate embodiment of the support arm.
Figure 8:
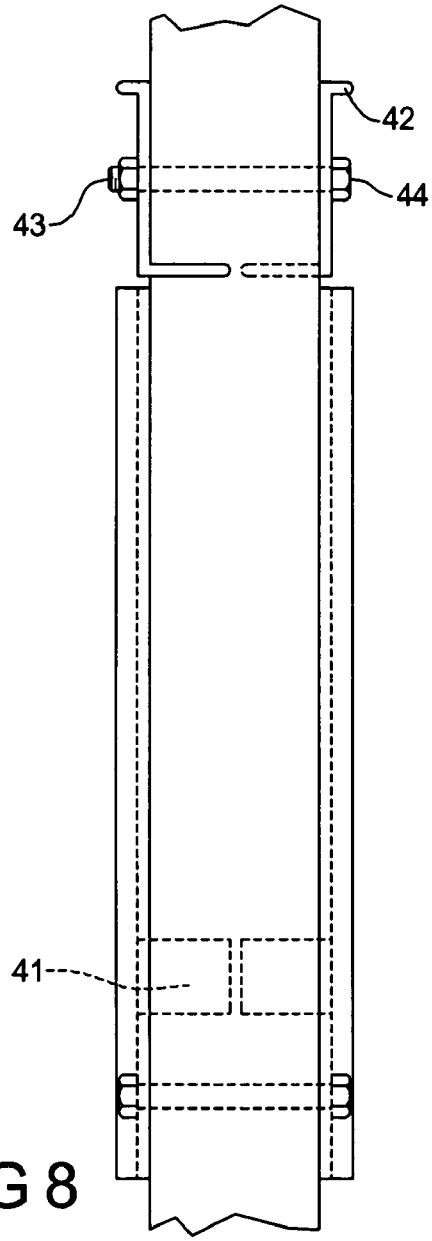
FIG. 8 is a top view of the FIG. 7 embodiment.

FIGS. 7–9 illustrate an alternate embodiment for the support arm 40 which is provided with a stop tab 41 and a thickened upper portion 42 for improving the strength of the support arm 40. The stop tab 41 is disposed outside of (and preferably, but not necessarily, substantially perpendicular to) the plane containing the main portion of the support arm 41. The stop tab 41 functions similar to the abovementioned end portions or stop members 4 and 31.

The support arm 40 is fastened with a nut 43 and bolt 44 arrangement.

The various support arms 1, 21 and 40 shown in all of the drawings and photographs may be fabricated from nylon, plastic, or stamped steel, or any suitable material having the necessary strength and rigidity.

While the present invention has been described hereinabove with respect to only several preferred embodiments for illustrative purposes only, it should be understood that the present invention encompasses and embraces all modifications, variations, and changes to the basic inventive concept.

All such variations and modifications are intended to be embraced within the scope of the present invention.

The invention claimed is:

1. A pivotable support arm device, comprising:

a support arm having a main straight elongated portion which is unitary and integral with a curved portion that is shaped and adapted to accommodate the passing therethrough of a pivot pin or bolt to pivotally connect at least one said support arm to an external elongated main support member;

said main straight elongated portion and said curved portion being disposed in a first predetermined plane;

said curved portion extending around and beyond said pivot pin to form an end portion that serves as a stop member;

said end portion/stop member being disposed in a second predetermined plane which is oriented perpendicular to said first predetermined plane; and whereby said support arm device is pivoted from a horizontal position for supporting an external article whereat a first predetermined portion of said end portion/stop member engages a first predetermined portion of said external main support member, to a vertical storage position whereat a second predetermined portion of said end portion/stop member engages a second predetermined portion of said external elongated main support member.

2. A pivotable support arm device according to claim 1, wherein:

said entire pivotable support arm device is fabricated from a unitary single piece of metallic stock.

3. A pivotable support arm device according to claim 1, wherein:

the entire pivotable support arm device is formed from a unitary piece of cylindrical metal stock.

4. A rack apparatus for storing a plurality of articles, comprising:

an elongated main support member;

base means for holding said elongated main support member in a substantially vertical orientation;

a plurality of pivotable support arm devices for supporting said plurality of articles;

means for selectively pivotably interconnecting said plurality of support arm devices with said elongated main support member;

each said pivotable support arm device comprising a support arm having a main straight elongated portion which is unitary and integral to a curved portion that is shaped and adapted to accommodate the passing therethrough of a pivot pin or bolt which pivotably connects at least one of said pivotable support arm devices to said elongated main support member;

said main straight elongated portion and said curved portion being disposed in a first determined plane;

said curved portion extends around and beyond said pivot pin or bolt to form an end portion that serves as a stop member;

said end portion/stop member being disposed in a second predetermined plane which is oriented perpendicular to said first predetermined plane; and whereby each said support arm device is pivoted from a horizontal position for supporting at least one of said plurality articles whereat a first predetermined portion of said end portion/stop member engages a first predetermined portion of said elongated main support member, to a vertical position of storage whereat a second predetermined portion of said end portion/stop member engages a second predetermined portion of said elongated main support member.

5. A rack apparatus according to claim 4, wherein:

said support arm device when in said position of storage is oriented parallel to said elongated main support member.

6. A rack apparatus according to claim 4, wherein:

each said pivot pin or bolt simultaneously secures a first said support arm device and a second said support arm device to said elongated main support member; and said first support arm device when in said horizontal position extends from said elongated main support member in a first direction, while said second support arm device when in said horizontal position extends from said elongated main support member in a second direction which is opposite to said first direction.

7. A rack apparatus according to claim 4, wherein:

each said support arm device is fabricated from a unitary single piece of metallic stock.

8. A rack apparatus according to claim 4, wherein:

the entire pivotable support arm device is formed from a unitary piece of cylindrical metal stock.

9. A rack apparatus according to claim 4, wherein:

each said support arm device is provided at one end thereof with means for impeding said article from slipping off said support arm device and for minimizing injuries to persons who might come into contact with said one end of said support arm device.

10. A rack apparatus according to claim 4, wherein:

said elongated main support member is in the shape of a prism having at least four main external sides; and each of said external sides has extending therefrom at least one said support arm device in a horizontal position for holding at least one of said plurality of said articles.

11. A rack apparatus according to claim 5, wherein:

said elongated main support member is in the shape of a prism having at least four main external sides; and each of said external sides has extending therefrom at least one said support arm device in its substantially horizontal position for holding at least one of said plurality of said articles.

12. A rack apparatus according to claim 6, wherein:

said elongated main support member is in the shape of a prism having at least four main external sides; and each of said external sides has extending therefrom at least one said support arm device in its substantially horizontal position for holding at least one of said plurality of said articles.

13. A rack apparatus according to claim 9, wherein:

said elongated main support member is in the shape of a prism having at least four main external sides; and each of said external sides has extending therefrom at least one said support arm device in its substantially horizontal position for holding at least one of said plurality of said articles.

* * * * *